US010246906B2

(12) United States Patent
Lin et al.

(10) Patent No.: US 10,246,906 B2
(45) Date of Patent: Apr. 2, 2019

(54) METHOD FOR CORRECTLY MOUNTING AN ELECTRONIC DOOR LOCK ON A LEFT-HANDED OR RIGHT-HANDED DOOR

(71) Applicant: Tong Lung Metal Industry Co., LTD, Chiayi County (TW)

(72) Inventors: Chen-Ming Lin, Chiayi County (TW); Tung-Yi Ho, Chiayi County (TW)

(73) Assignee: Tong Lung Metal Industry Co., LTD., Chiayi County (TW)

( * ) Notice: Subject to any disclaimer, the term of this patent is extended or adjusted under 35 U.S.C. 154(b) by 841 days.

(21) Appl. No.: 14/691,758

(22) Filed: Apr. 21, 2015

(65) Prior Publication Data

US 2015/0308157 A1 Oct. 29, 2015

(30) Foreign Application Priority Data

Apr. 23, 2014 (TW) ..... 103114754 A

(51) Int. Cl.
*E05B 63/04* (2006.01)
*E05B 47/02* (2006.01)
*E05B 47/00* (2006.01)

(52) U.S. Cl.
CPC ..... *E05B 63/04* (2013.01); *E05B 47/026* (2013.01); *E05B 47/0012* (2013.01); *E05B 2047/002* (2013.01); *E05B 2047/0091* (2013.01)

(58) Field of Classification Search
CPC ..... E05B 3/00; E05B 63/04; E05B 47/026; E05B 47/0012; E05B 2047/002; E05B 2047/0091; E05B 63/0056; Y10S 292/30; Y10S 292/53; Y10S 292/64; Y10T 292/1021; Y10T 292/1018; Y10T 292/57; Y10T 292/59; Y10T 292/93; Y10T 292/96; Y10T 70/7062; Y10T 70/8838; Y10T 70/8865; Y10T 70/8973
USPC ..... 292/144, 142, 336.3, 336.5, 358, 359, 292/DIG. 30, DIG. 53, DIG. 64; 70/277, 70/461, 462, 466
See application file for complete search history.

(56) References Cited

U.S. PATENT DOCUMENTS 5,809,812 A * 9/1998 Gallego ..... E05B 59/00 292/21
6,585,302 B2 * 7/2003 Lin ..... E05B 47/0012 292/142
8,291,733 B2 * 10/2012 Chiou ..... E05B 47/0661 292/279
8,375,567 B2 * 2/2013 Huang ..... B23P 11/00 29/428

(Continued)

*Primary Examiner* — Christine M Mills
(74) *Attorney, Agent, or Firm* — LeClairRyan

(57) ABSTRACT

A method of mounting an electronic door lock on a door includes: a manual operation to rotate a protrusion of a rotational actuator to initially press a switch; and an operating procedure implemented by the electronic lock for determining a correct mounting direction of the electronic door lock. The operating procedure includes controlling, in response to a signal sent by the switch that is initially pressed, a driving unit to rotate the protrusion in a direction from the initially pressed switch to the other initially unpressed switch and to drive a latch to move from an unlatched position toward a latched position, followed by stopping and subsequently controlling the driving unit to rotate the protrusion in a reverse direction and to drive the latch to move toward the unlatched position.

6 Claims, 10 Drawing Sheets

(56) References Cited

U.S. PATENT DOCUMENTS

| | | | | |
|---|---|---|---|---|
| 8,490,445 | B2 * | 7/2013 | Chiou | E05B 47/0012 70/224 |
| 2009/0322473 | A1 * | 12/2009 | Aliferis | E05B 47/026 340/5.7 |
| 2011/0259059 | A1 * | 10/2011 | Wu | E05B 47/0012 70/91 |
| 2013/0169411 | A1 * | 7/2013 | Chan | G05B 1/00 340/5.54 |
| 2015/0167365 | A1 * | 6/2015 | Musser | F16M 13/02 340/542 |
| 2017/0370127 | A1 * | 12/2017 | Huang | E05B 17/06 |

* cited by examiner

METHOD FOR CORRECTLY MOUNTING AN ELECTRONIC DOOR LOCK ON A LEFT-HANDED OR RIGHT-HANDED DOOR

CROSS-REFERENCE TO RELATED APPLICATION

This application claims priority of Taiwanese Application No. 103114754, filed on Apr. 23, 2014.

FIELD

The invention relates to a method for mounting an electronic door lock on a door, more particularly to a method for correctly mounting an electronic door lock on a left-handed or right-handed door.

BACKGROUND

A conventional electronic door lock may be incorrectly mounted on a left-handed or right-handed door. U.S. Pat. No. 8,375,567 B2 discloses a method for automatically determining the direction installation of an electronic lock. The method achieves automatic determination of the electronic lock installed on the left-handed or right-handed door by controlling rotational directions of the rotational actuator and determining the touching sequence of switch units, so as to enable the electronic lock to be adapted to both the left-handed door and right-handed door. The method is fully automated. The U.S. patent does not disclose any manual operating step that is permitted to combine with the fully automated method.

SUMMARY

Therefore, an object of the present disclosure is to provide a method for correctly mounting an electronic door lock on a left-handed or right-handed door, which is semi-automatic and which is convenient for a user to conduct a manual operation in combination with an automatic operation procedure.

According to this disclosure, there is provided a method for correctly mounting an electronic door lock on a left-handed door having an openable left side, or right-handed door having an openable right side. The electronic door lock includes a latch and an inside lock body. The inside lock body includes a rotary handle, a rotational actuator that includes a protrusion, a driving unit, a control unit, a first switch that is configured to send a first signal, and a second switch that is configured to send a second signal.

The method includes the steps of:

a) assembling the latch on the left-handed or right-handed door and placing the latch at an unlatched position, wherein: when the latch is assembled on the right-handed door, the latch is proximal to the openable right side; when the latch is assembled on the left-handed door, the latch is proximal to the openable left side;

b) after step (a), turning the rotary handle to rotate the rotational actuator in such a manner that the protrusion initially presses one of the first and second switches, and then, assembling the inside lock body on the left-handed or right-handed door, wherein the protrusion presses the first switch that is proximal to the openable right side when the electronic door lock is assembled on the right-handed door, and presses the second switch that is proximal to the openable left side when the electronic door lock is assembled on the left-handed door; and c) after the electronic door lock is assembled on the left-handed or right-handed door, electrically energizing the electronic door lock such that the control unit automatically implements an operating procedure for determining a correct mounting direction of the electronic door lock, the operating procedure including the steps of:

c1) when the protrusion initially presses the one of the first and second switches to generate one of the first and second signals, controlling the driving unit, in response to receipt of the one of the first and second signals, to drive the rotational actuator and the protrusion to rotate in a first direction from the one of the first and second switches that is initially pressed to the other one of the first and second switches that is initially un-pressed, and to drive the latch to move from the unlatched position toward a latched position;

c2) when the latch is moved to the latched position and when the protrusion is rotated to the other one of the first and second switches that is initially un-pressed to send the other one of the first and second signals, stopping the driving unit in response to receipt of the other one of the first and second signals;

c3) after step c2), controlling the driving unit to drive the rotational actuator and the protrusion to rotate in a second direction from the other one of the first and second switches that is initially un-pressed to the one of the first and second switches that is initially pressed, and to drive the latch to move from the latched position toward the unlatched position;

c4) when the latch is moved to the unlatched position and when the protrusion is rotated once again to the one of the first and second switches that is initially pressed to send the one of the first and second signals, stopping the driving unit in response to receipt of the one of the first and second signals; and c5) confirming that the electronic door lock is mounted to the left-handed or right-handed door with a correct mounting direction when steps c1) to c4) are successfully implemented.

Another object of this disclosure is to provide an electronic door lock including a first switch, a second switch, a rotational actuator, a driving unit, a latch and a control unit.

The first switch is configured to send a first signal, and the second switch is angularly spaced apart from the first switch and is configured to send a second signal. The rotational actuator includes a protrusion to rotate between a first angular position, where the protrusion presses and actuates the first switch to send the first signal, and a second angular position, where the protrusion presses and actuates the second switch to send the second signal. The driving unit is connected to the rotational actuator for driving the rotational actuator to rotate between the first and second angular positions. The latch is connected to and driven by the rotational actuator to be moved between a latched position and an unlatched position when the rotational actuator is driven by the driving unit. The control unit is coupled to the driving unit, and is electrically connected to the first and second switches for receiving the first and second signals therefrom.

When the electronic door lock is assembled on the left-handed or right-handed door, the latch is initially placed at the unlatched position, the protrusion is initially placed at one of the first and second angular positions, and the control unit is operable to automatically implement an operating procedure for determining a correct mounting direction of the electronic door lock to a door, the operating procedure including the steps of:

i) when the protrusion is initially presses the one of the first and second switches to generate the one of the first and second signals and when the latch is initially placed at the unlatched position, controlling the driving unit, in response to the one of the first and second signals, to drive the rotational actuator and the protrusion to rotate in a first direction from the one of the first and second switches that is initially pressed to the other one of the first and second switches that is initially un-pressed and to drive the latch to move from the unlatched position toward a latched position;

ii) when the latch is moved to the latched position and when the protrusion is rotated to the other one of the first and second switches that is initially un-pressed to send the other one of the first and second signals, stopping the driving unit in response to the other one of the first and second signals, iii) after step ii), controlling the driving unit to drive the rotational actuator and the protrusion to rotate in a second direction from the other one of the first and second switches that is initially un-pressed to the one of the first and second switches that is initially pressed and to drive the latch to move from the latched position toward the unlatched position, iv) when the latch is moved to the unlatched position and when the protrusion initially presses the one of the first and second switches that is initially pressed to send the one of the first and second signals, stopping the driving unit in response to the one of the first and second signals, and v) confirming that the electronic door lock is mounted to the left-handed or right-handed door with a correct mounting direction when steps i) to iv) are successfully implemented.

BRIEF DESCRIPTION OF THE DRAWING

Other features and advantages of the present disclosure will become apparent in the following detailed description of the embodiment of this disclosure with reference to the accompanying drawing, of which.

DETAILED DESCRIPTION

Figure 1:
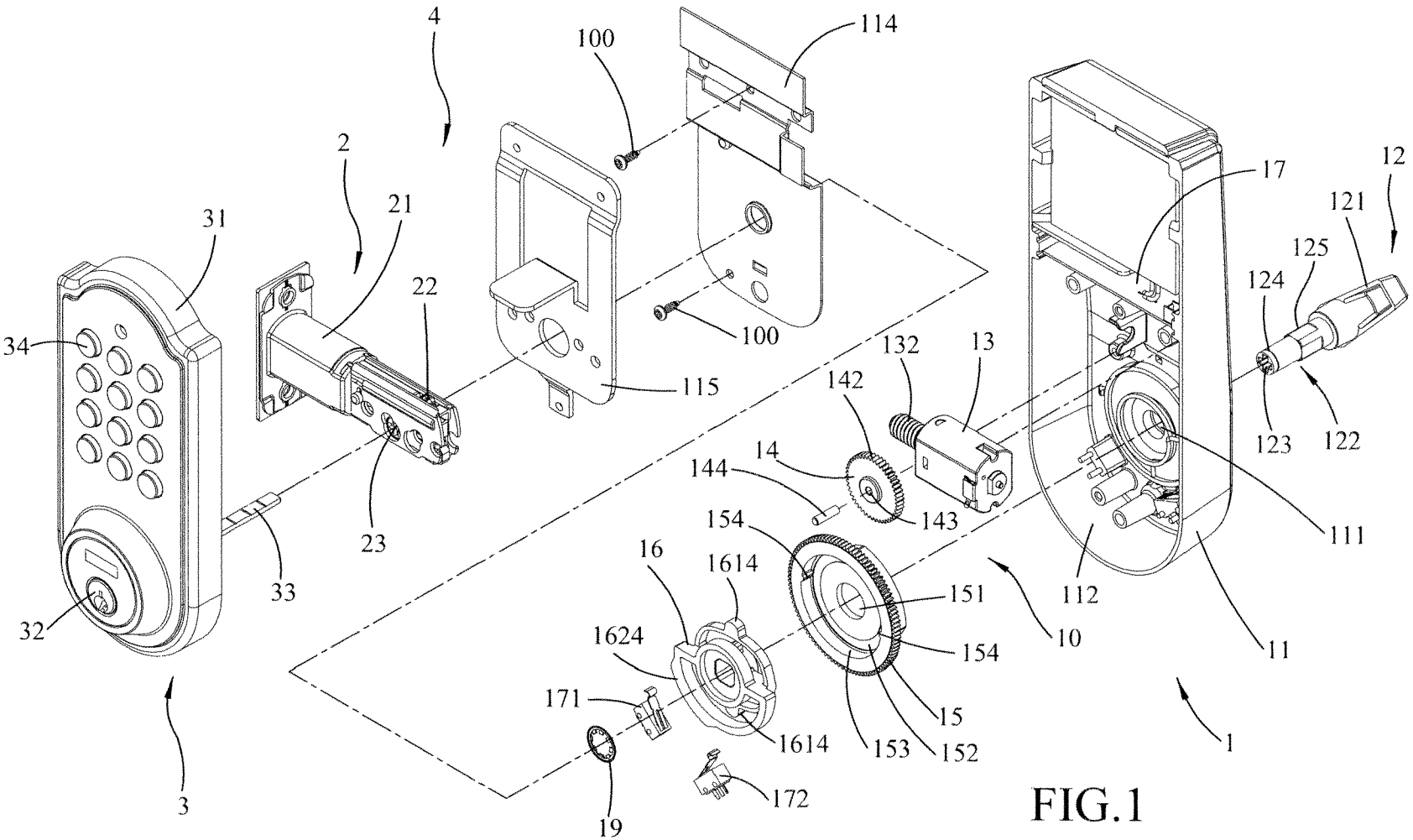
FIG. 1 is an exploded perspective view of an electronic door lock according to an embodiment of this disclosure.
Figure 2:
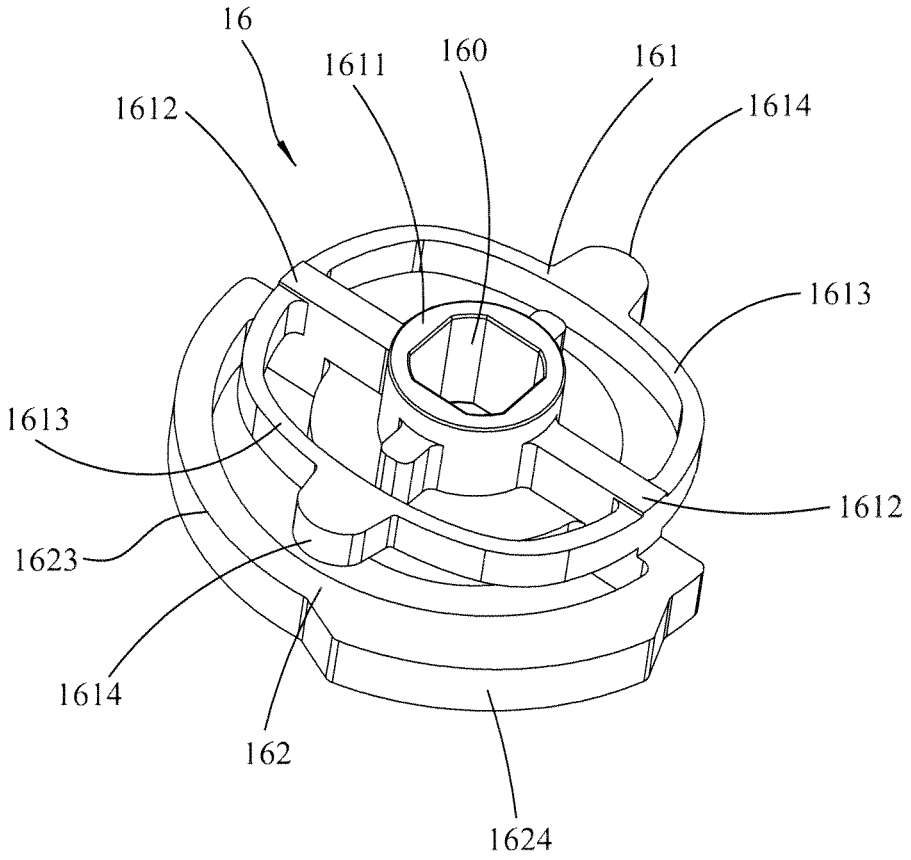
FIGS. 2 and 3 are perspective views of a rotational actuator of the electronic door lock.
Figure 3:
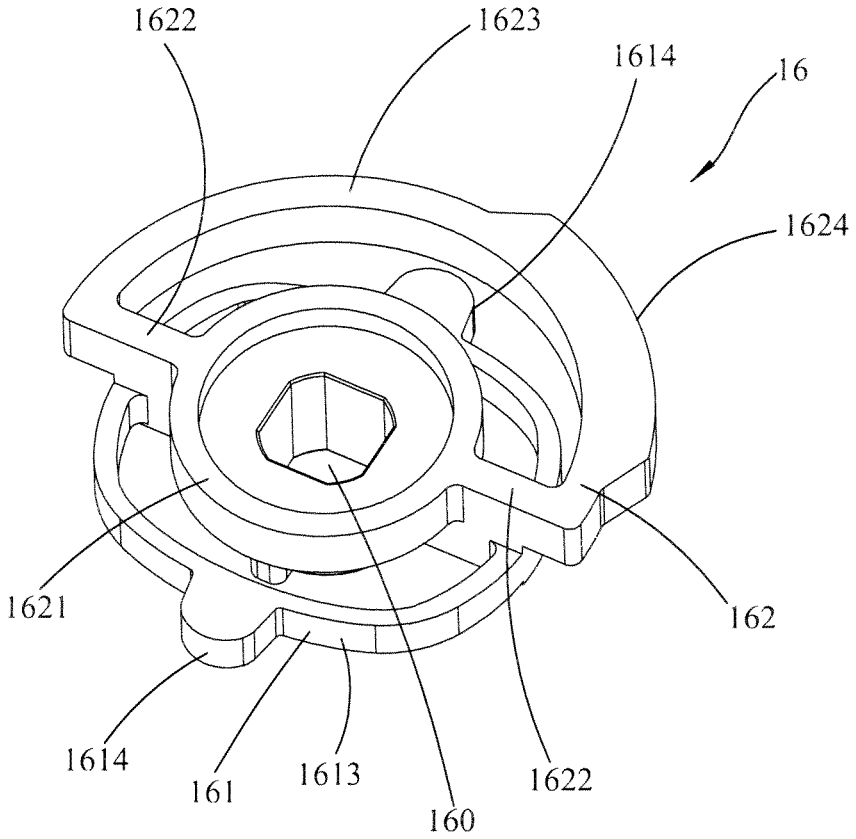
Figure 4:
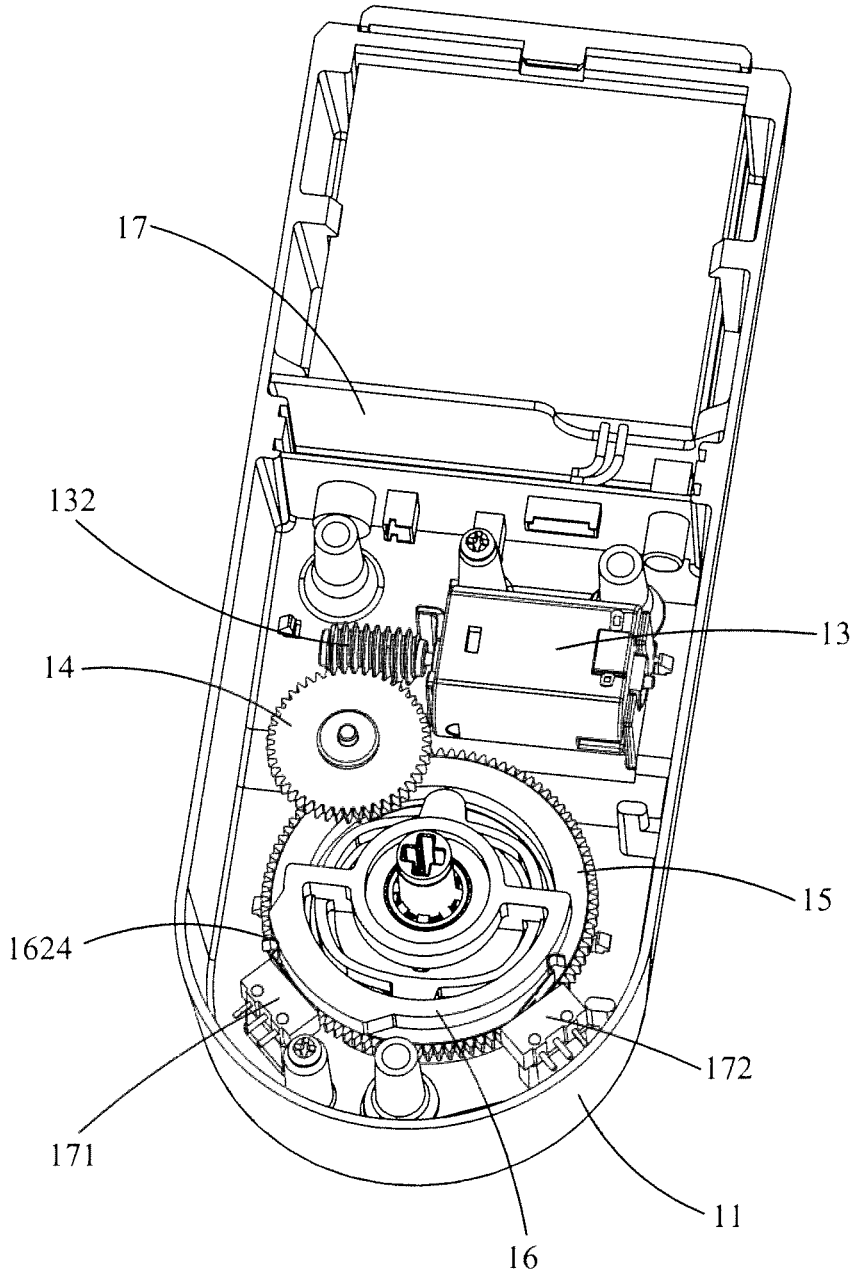
FIG. 4 is a perspective view of an inside lock body of the electronic door lock.

Referring to FIGS. 1 to 4, an electronic door lock 4 according to an embodiment of this disclosure includes an inside lock body 1, a latch unit 2 and an outside lock body 3. The inside lock body 1 and the outside lock body 3 are configured to be mounted respectively on an inside and an outside of a door (not shown). In particular, the inside lock body 1 is manually operable to lock and unlock the door, and the outside lock body 3 is electronically operable to lock and unlock the door. The inside lock body 1 includes a driving unit 10, an inside housing 11, a rotary handle 12, a rotational actuator 16, a control unit 17, and first and second switches 171 and 172. The inside housing 11 is formed with a through hole 111, and defines an accommodating space 112 therein for receiving the driving unit 10, the rotational actuator 16, the control unit 17 and the first and second switches 171, 172. In this embodiment, the first and second switches 171, 172 are micro-switches.

The rotary handle 12 has a grip portion 121 adapted to be gripped by a user, and a shaft portion 122 connected to the grip portion 121 and extending through the through hole 111 of the inside housing 11. The shaft portion 122 has a distal end formed with a cross-shaped slot 123, and a square pillar segment 125 connected between the distal end and the grip portion 121. The shaft portion 122 is further formed with an annular groove 124 extending around the shaft portion 122 at a position adjacent to the distal end.

The driving unit 10 includes a driving device 13, a driving wheel 14 and a transmission wheel 15. In this embodiment, the driving device 13 is a motor capable of forward and reverse rotation and is provided with a worm shaft 132. The driving wheel 14 is formed with a central aperture 143, and includes a worm wheel 142 meshing with the worm shaft 132 for reducing rotational speed, a transmission gear (not shown) smaller than and coaxially stacked with the worm wheel 142, and a pin 144 extending through the central aperture 143 and connected to the inside housing 11. The transmission wheel 15 is connected coaxially to and disposed partially around the rotational actuator 16. The transmission wheel 15 is a gear meshing with the transmission gear of the driving wheel 14 for reducing rotational speed, and is formed with a central through hole 151 through which the shaft portion 122 of the rotary handle 12 extends. The transmission wheel 15 is rotatable with respect to the shaft portion 122 of the rotary handle 12. The transmission wheel 15 has an inner surrounding wall 153 defining a circular receiving space 152, and two driving elements 154 protruding inwardly from the inner surrounding wall 153 into the circular receiving space 152. The driving elements 154 are angularly spaced apart by an angle of 180 degrees, and each has a rounded outer surface.

The rotational actuator 16 is formed with a square central hole 160 into which the shaft portion 122 of the rotary handle 12 is inserted. A retaining ring 19 is received in the annular groove 124 on the shaft portion 122 to inter-engage the shaft portion 122 and the rotational actuator 16 so as to prevent axial movement of the rotational actuator 16. The square pillar segment 125 of the shaft portion 122 fittingly engages the central hole 160 so that the rotational actuator 16 is co-rotatable with the rotary handle 12.

The rotational actuator 16 is disposed partially within the circular receiving space 152 of the transmission wheel 15, and includes a first part 161 and a second part 162. The first part 161 has a first ring 1611, two first diametrical ribs 1612, two first ring halves 1613 and two tongues 1614. The first ring 1611 is formed around a rotation axis of the rotational actuator 16. The first diametrical ribs 1612 extend outwardly from the first ring 1611 respectively in two opposite diametrical directions. The first ring halves 1613 are diametrically opposite to each other, and each has two opposite ends respectively connected to outer ends of the first diametrical ribs 1612. Each of the tongues 1614 projects radially and outwardly from a central part of a corresponding one of the first ring halves 1613 so that the tongues 1614 are resiliently movable. The tongues 1614 are angularly spaced apart by an angle of 180 degrees, and each of the tongues 1614 has a rounded outer surface.

The second part 162 of the rotational actuator 16 has a second ring 1621, two second diametrical ribs 1622, a second ring half 1623 and a protrusion 1624. The second ring 1621 is formed integrally with the first ring 1611 around the rotation axis of the rotational actuator 16. The second diametrical ribs 1622 extend outwardly from the second ring 1621 respectively in two opposite diametrical directions. The second ring half 1623 has two opposite ends respectively connected to outer ends of the second diametrical ribs 1622. The protrusion 1624 projects outwardly and radially from the second ring half 1623. In assembly, the rotary handle 12 is inserted into the central hole 160 of the rotational actuator 16, and the protrusion 1624 of the rotational actuator 16 is aligned with the grip portion 121 of the rotary handle 12 along a line parallel to the rotation axis of the rotational actuator 16.

The control unit 17 is disposed in the accommodating space 112, and is provided with control circuitry and chip (not shown). The first and second switches 171, are angularly spaced apart from each other substantially by 90 degrees. The first switch 171 is configured to send a first signal when the protrusion 1624 is placed in a first angular position (see FIG. 5) and presses the first switch 171. The second switch 172 is configured to send a second signal when the protrusion 1624 is placed in a second angular position (see FIG. 6) and presses the second switch 172. The control unit 17 is coupled to the driving unit 10, and is electrically connected to the first and second switches 171, 172 for receiving the first and second signals therefrom so that the control unit 17 is aware that the protrusion 1624 is placed in which one of the first and second angular positions.

The inside lock body 1 further includes a first plate 114 that protects the components disposed in the accommodating space 112 and that is screwed to the inside housing 11 by screws 100, and a second plate 115 that covers at least part of an opening of the accommodating space 112.

Figure 5:
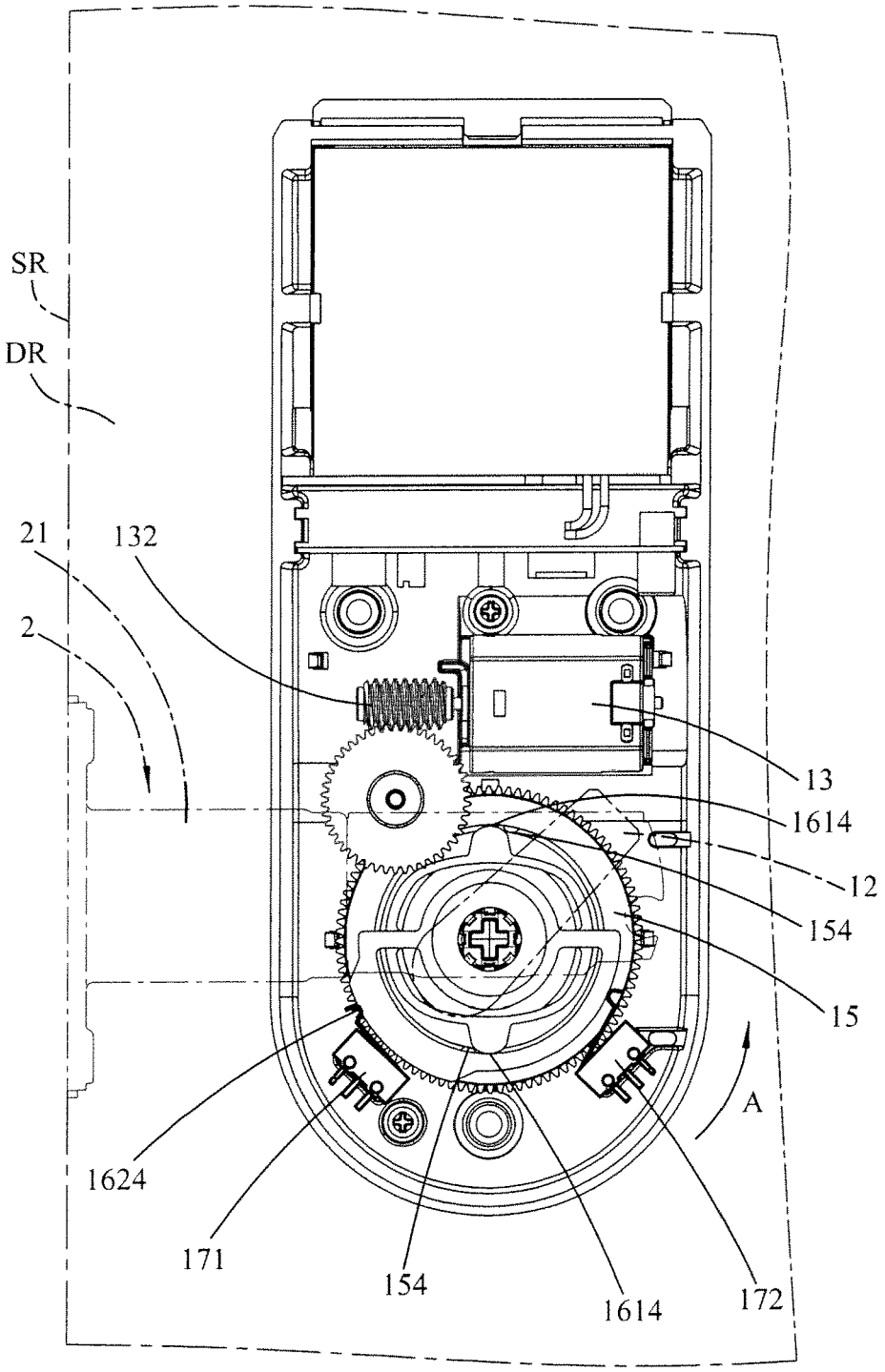
FIGS. 5 to 7 show an operation of components of the inside lock body to implement an operating procedure for determining a correct mounting direction of the electronic door lock when the electronic door lock is mounted on a right-handed door.
Figure 6:
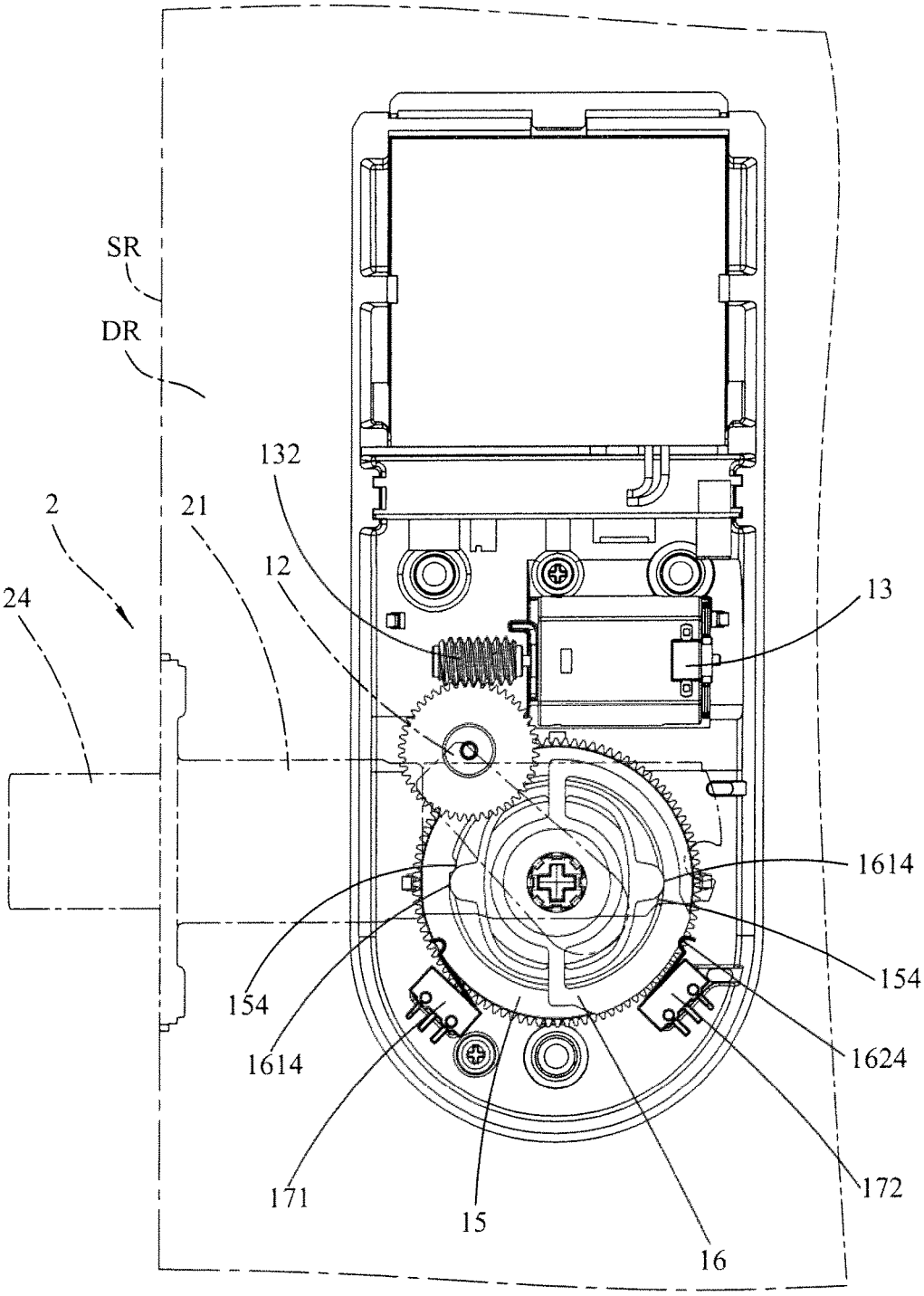

The latch unit 2 in this embodiment is a deadbolt latch mechanism and includes a housing 21, a latch drive 22 having a tailpiece through hole 23, and a latch 24 driven by the latch drive 22 to switch between an unlatched position (see FIG. 5) and a latched position (see FIG. 6). The latch 24 is not visible in FIG. 5 since the latch 24 is retracted into the housing 21 in the unlatched position.

The outside lock body 3 includes an outside housing 31, a lock body 32, a tailpiece 33 and an electronic operation module 34. The electronic operation module 34 is a set of buttons in this embodiment. Alternatively, the electronic operation module 34 may be a fingerprint recognition device, a remote control device, touch panel, etc. The electronic operation module 34 is electrically connected to the control unit 17. The tailpiece 33 is connected to the lock body 32, extends through the tailpiece through hole 23 of the latch drive 22, and is inserted into the slot 123 of the shaft portion 122 of the rotary handle 12. The tailpiece 33 lies horizontally in the slot 123 in FIG. 1.

When the user twists the rotary handle 12, the tailpiece 33 co-rotates with the rotary handle 12, and operates the latch drive 22 so that the latch 24 is driven to move between the latched position and the unlatched position. When the user operates the electronic door lock 4 with the outside lock body 3 (i.e., using the electronic operation module 34), the transmission wheel 15 is driven to rotate by the driving device 13, and the driving elements 154 of the transmission wheel 15 respectively push and drive the tongues 1614 of the rotational actuator 16 so that the rotational actuator 16 rotates together with the transmission wheel 15 and the rotary handle 12. As a result, the latch 24 moves between the latched and unlatched positions.

Further referring to FIGS. 5 to 7, when the electronic door lock 4 is mounted on a right-handed door (DR) having an openable right side (SR), a method for correctly mounting the electronic door lock 4 on the right-handed door (DR) is implemented as follows.

First, the outside lock body 3 and the latch unit 2 of the electronic door lock 4 are assembled on the right-handed door (DR). At this time, the tailpiece 33 lies horizontally in the tailpiece through hole 23, and the latch 24 is proximal to the openable right side (SR) of the right-handed door (DR) and is at the unlatched position as shown in FIG. 5. By manually rotating the rotary handle 12, the protrusion 1624 of the rotational actuator 16 is initially placed in the first angular position so that the protrusion 1624 presses the first switch 171. Then, the inside lock body 1 of the electronic door lock 4 is mounted on the right-handed door (DR), the first switch 171 is placed proximally to the openable right side (SR) of the right-handed door (DR), and the tailpiece 33 is inserted horizontally into the slot 123. After the electronic door lock 4 is assembled on the right-handed door (DR), the electronic door lock 4 is electrically energized such that the control unit 17 automatically implements an operating procedure for determining a correct mounting direction of the electronic door lock 4. The operating procedure includes the following steps R1 to R5.

In step R1, when the protrusion 1624 is initially placed at the first angular position to generate the first signal and when the latch 24 is initially placed at the unlatched position, the control unit 17 detects that the first switch is pressed by the protrusion 1624, and controls the driving device 13 of the driving unit 10, in response to receipt of the first signal, to operate for driving the rotational actuator 16 and the protrusion 1624 to rotate in a first direction from the first switch 171 that is initially pressed to the second switch 172 that is initially un-pressed (i.e., the direction (A) in FIG. 5), and for driving the latch 24 to move from the unlatched position toward the latched position.

In step R2, when the latch 24 is moved to the latched position and when the protrusion 1624 is rotated to the second angular position where the protrusion 1624 presses the second switch 172 that is initially un-pressed to send the second signal, the control unit 17 stops the driving unit 10 in response to receipt of the second signal. During rotating from the first angular position to the second angular position, the protrusion 1624 moves to and presses the second switch 172 after leaving and releasing the first switch 171.

Figure 7:
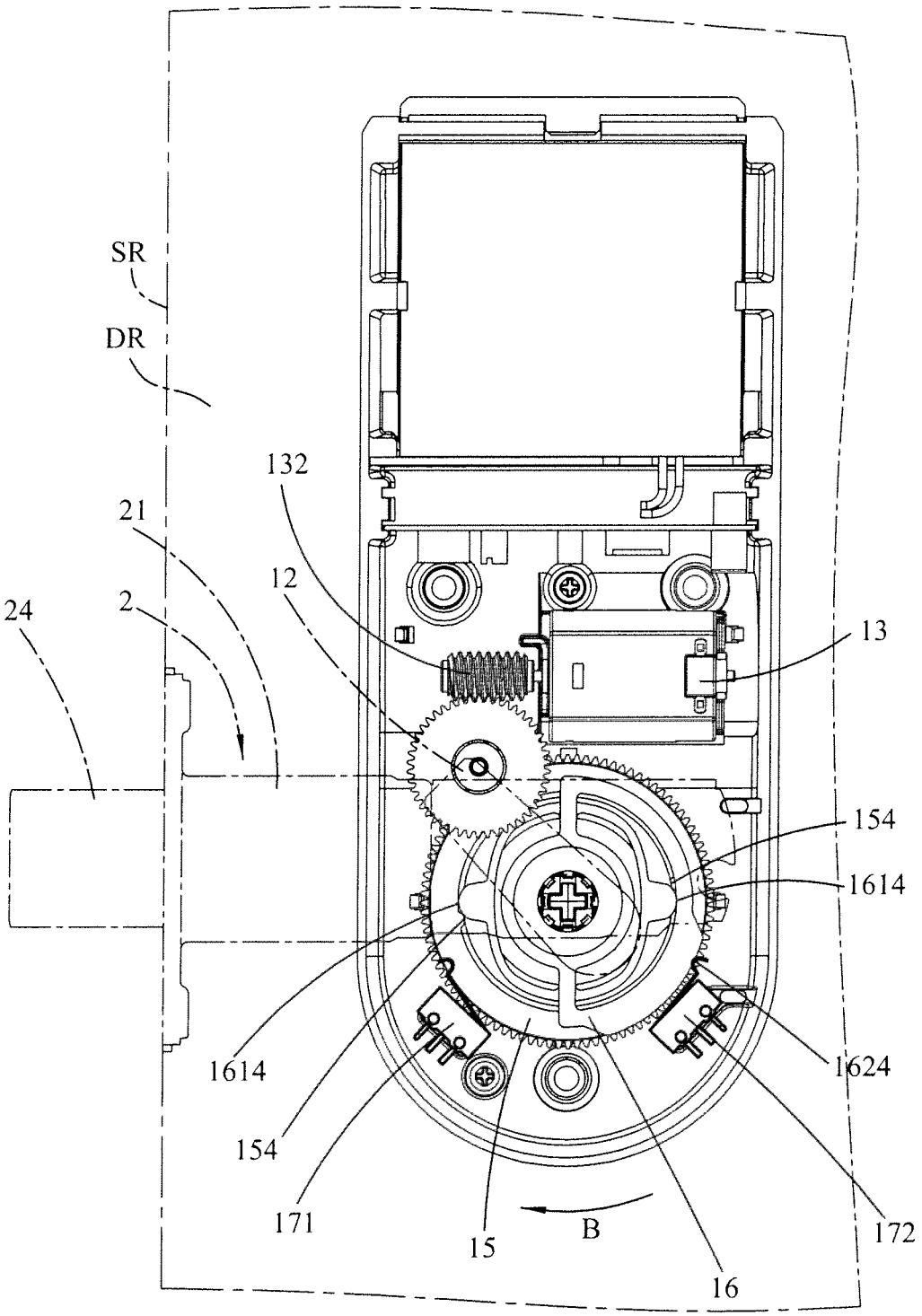

In step R3, after step R2, the control unit 17 controls the driving device 13 of the driving unit 10 to operate for driving the rotational actuator 16 and the protrusion 1624 to rotate in a second direction from the second switch 172 that is initially un-pressed to the first switch 171 that is initially pressed (i.e., the direction (B) in FIG. 7 opposite to the direction (A) in FIG. 5), and for driving the latch 24 to move from the latched position toward the unlatched position.

In step R4, when the latch 24 is moved to the unlatched position and when the protrusion 1624 is rotated once again to the first angular position where the first switch 171 is pressed to send the first signal, the control unit 17 stops the driving unit 10 in response to receipt of the first signal.

In step R5, the control unit 17 confirms that the electronic door lock 4 is mounted to the right-handed door (DR) with a correct mounting direction when steps R1 to R4 are successfully implemented. Otherwise, the control unit 17 will further implements the step of outputting a warning signal informing that the electronic door lock 4 should be disassembled from the right-handed door (DR) for re-mounting. For example, in order to re-mount the electronic door lock 4, the inside lock body 1 is disassembled from the door, so that the rotational actuator 16 can be adjusted for placing the protrusion 1624 correctly in the first angular position by manually rotating the rotary handle 12.

In this embodiment, the warning signal is outputted when step R2 is not implemented after step R1, when the control unit 17 fails to receive the second signal after the driving unit 10 operates for a predetermined length of time (e.g., 3 seconds) in step R1, or when the control unit 17 fails to receive the first signal after the driving unit 10 operates for the predetermined length of time in step R3. In this condition, the inside lock body 1 should be disassembled from the door, and the rotational actuator 16 should be adjusted by manually rotating the rotary handle 12. After the inside lock body 1 is re-mounted to the door, steps R1 to R5 may be repeated for re-confirmation.

After the electronic door lock 4 is successfully mounted to the right-handed door (DR), as shown in FIG. 5, the latch 24 is in the unlatched position when the protrusion 1624 of the rotational actuator 16 presses the first switch 171. The pressing of the first switch 171 is able to inform the control unit 17 that the latch is currently at the unlatched position. At this time, the driving element 154 at the upper side of the transmission wheel 15 is situated at the right side in FIG. 5. If the user operates the electronic operation module 34 for unlocking the electronic door lock 4 (or unlatching the latch 24) in this condition, an error warning output will be generated.

When the user wants to lock the electronic door lock 4 using the rotary handle 12, the user may manually twist the rotary handle 12 to drive the rotational actuator 16 to rotate in the direction (A). Since the rotary handle 12, the tailpiece 33 and the rotational actuator 16 are co-rotatable, the tailpiece 33 drives the latch drive 22 to move the latch 24 from the unlatched position toward the latched position when the user twists the rotary handle 12. In the meanwhile, as shown in FIG. 6, the protrusion 1624 of the rotational actuator 16 moves to the second angular position and presses the second switch 172. The pressing of the second switch 172 is able to inform the control unit 17 that the latch is currently at the latched position. If the user operates the electronic operation module 34 for locking the electronic door lock 4 (or for latching the latch 24) in this condition, an error warning output is generated. When the user wants to unlock the electronic door lock 4 using the rotary handle 12, the user may twist the rotary handle 12 in the direction (B) opposite to the direction (A). Similarly, the lock body 32 of the outside lock body 3 can be manually operated with a particular key to achieve the same function.

When the user wants to lock the electronic door lock 4 using the electronic operation module 34, the user may operate the electronic operation module 34 (e.g., by inputting a password) to send a locking signal to the control unit 17. In response to receipt of the locking signal, the control unit 17 controls the driving device (motor) 13 to rotate the worm shaft 132. As a result, the worm shaft 132 drives rotation of the driving wheel 14 which in turn drives the transmission wheel 15 to rotate in the direction (A) so that the driving elements 154 of the transmission wheel 15 move respectively toward the tongues 1614 of the rotational actuator 16, and push and drive the same. Therefore, the rotational actuator 16 rotates in the direction (A), and the protrusion 1624 moves to the second angular position as shown in FIG. 6. At this time, the rotational actuator 16 is unable to rotate further in the direction (A) since the latch 24 is at the latched position. However, as the driving device 13 is still rotatable for a predetermine time period to drive the transmission wheel 15 to further rotate, the driving elements 154 are slidable respectively over the rounded outer surfaces of the tongues 1614 as shown in FIG. 7. As a result, the driving elements 154 will not interfere with the tongues 1614 when the user manually operates the rotary handle 12 to rotate the rotational actuator 16 in the direction (B) for unlocking the electronic door lock 4. When the user wants to unlock the electronic door lock 4 using electronic operation module 34, the operation sequence and rotation direction are just inverse, and details thereof are omitted herein for the sake of brevity.

Referring to FIGS. 1 and 8 to 10, when the electronic door lock 4 is mounted on a left-handed door (DL) having an openable left side (SL), a method for correctly mounting the electronic door lock 4 on the left-handed door (DL) is implemented as follows.

Figure 8:
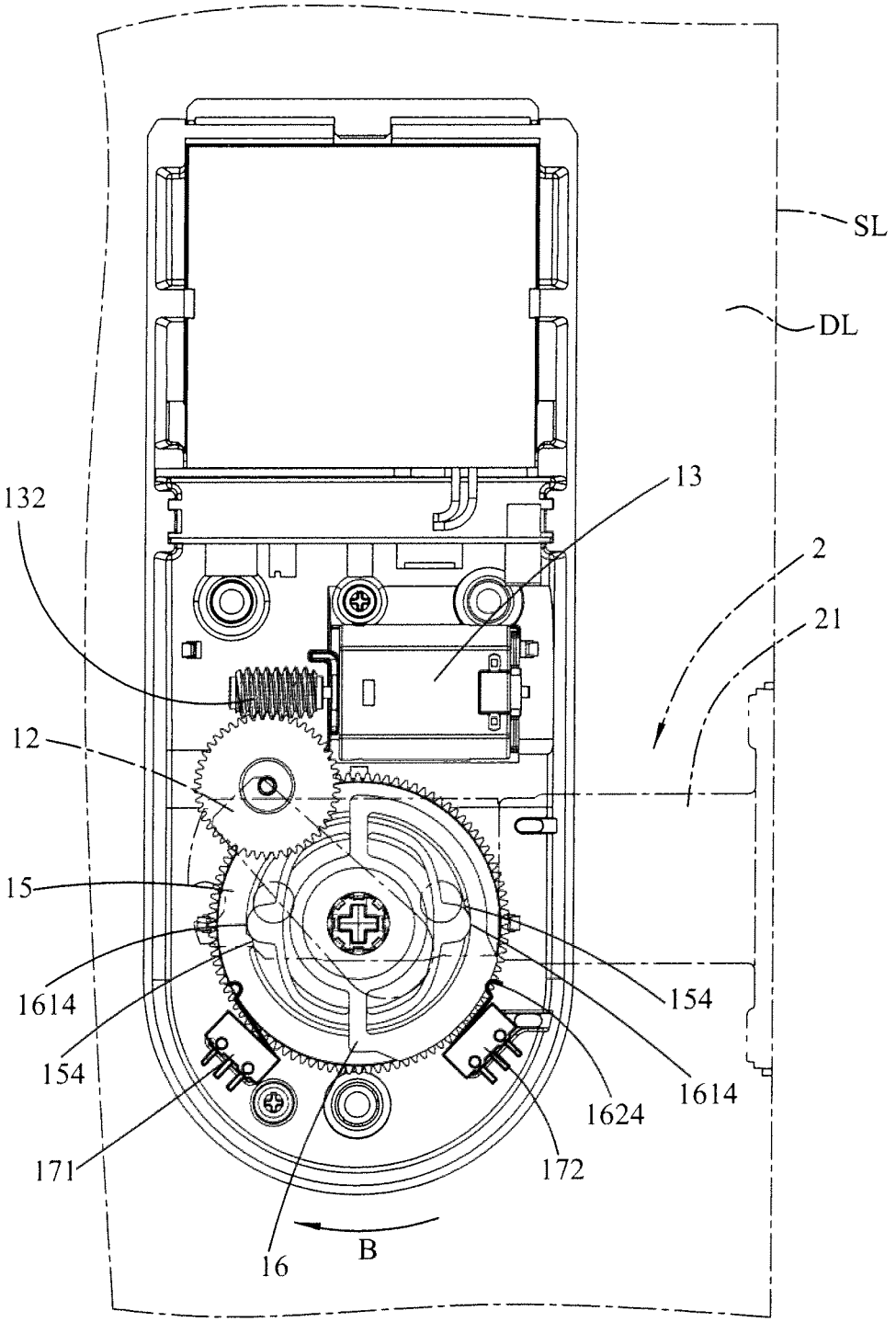
FIGS. 8 to 10 show an operation of components of the inside lock body to implement the operating procedure for determining a correct mounting direction of the electronic door lock when the electronic door lock is mounted on a left-handed door.

First, the outside lock body 3 and the latch unit 2 of the electronic door lock 4 are assembled on the left-handed door (DL). At this time, the tailpiece 33 lies horizontally in the tailpiece through hole 23, and the latch 24 is proximal to the openable left side (SL) of the left-handed door (DL) and is at the unlatched position, as shown in FIG. 8. Thereafter, the rotary handle 12 is rotated manually to initially place the protrusion 1624 of the rotational actuator 16 in the second angular position where the protrusion 1624 presses the second switch 172. Then, the inside lock body 1 of the electronic door lock 4 is mounted on the left-handed door (DL), the second switch 172 is placed proximally to the openable left side (SL) of the left-handed door (DL), and the tailpiece 33 is inserted horizontally into the slot 123. After the electronic door lock 4 is assembled on the left-handed door (DL), the electronic door lock 4 is electrically energized such that the control unit 17 automatically implements an operating procedure for determining a correct mounting direction of the electronic door lock 4. The operating procedure includes the following steps L1 to L5.

In step L1, when the protrusion 1624 is initially placed at the second angular position to generate the second signal and when the latch 24 is initially placed at the unlatched position, the control unit 17 controls the driving device 13 of the driving unit 10, in response to receipt of the second signal, to operate for driving the rotational actuator 16 and the protrusion 1624 to rotate in a first direction) from the second switch 172 that is initially pressed to the first switch 171 that is initially un-pressed (i.e., the direction (B) in FIG. 8), and for driving the latch 24 to move from the unlatched position toward the latched position.

In step L2, when the latch 24 is moved to the latched position and when the protrusion 1624 is rotated to the first angular position where the protrusion 1624 presses the first switch 171 that is initially un-pressed to send the first signal, the control unit 17 stops the driving unit 10 in response to receipt of the first signal. In particular, during rotating from the second angular posit ion to the first angular position, the protrusion 1624 moves to and presses the first switch 171 after leaving and releasing the second switch 172.

Figure 10:
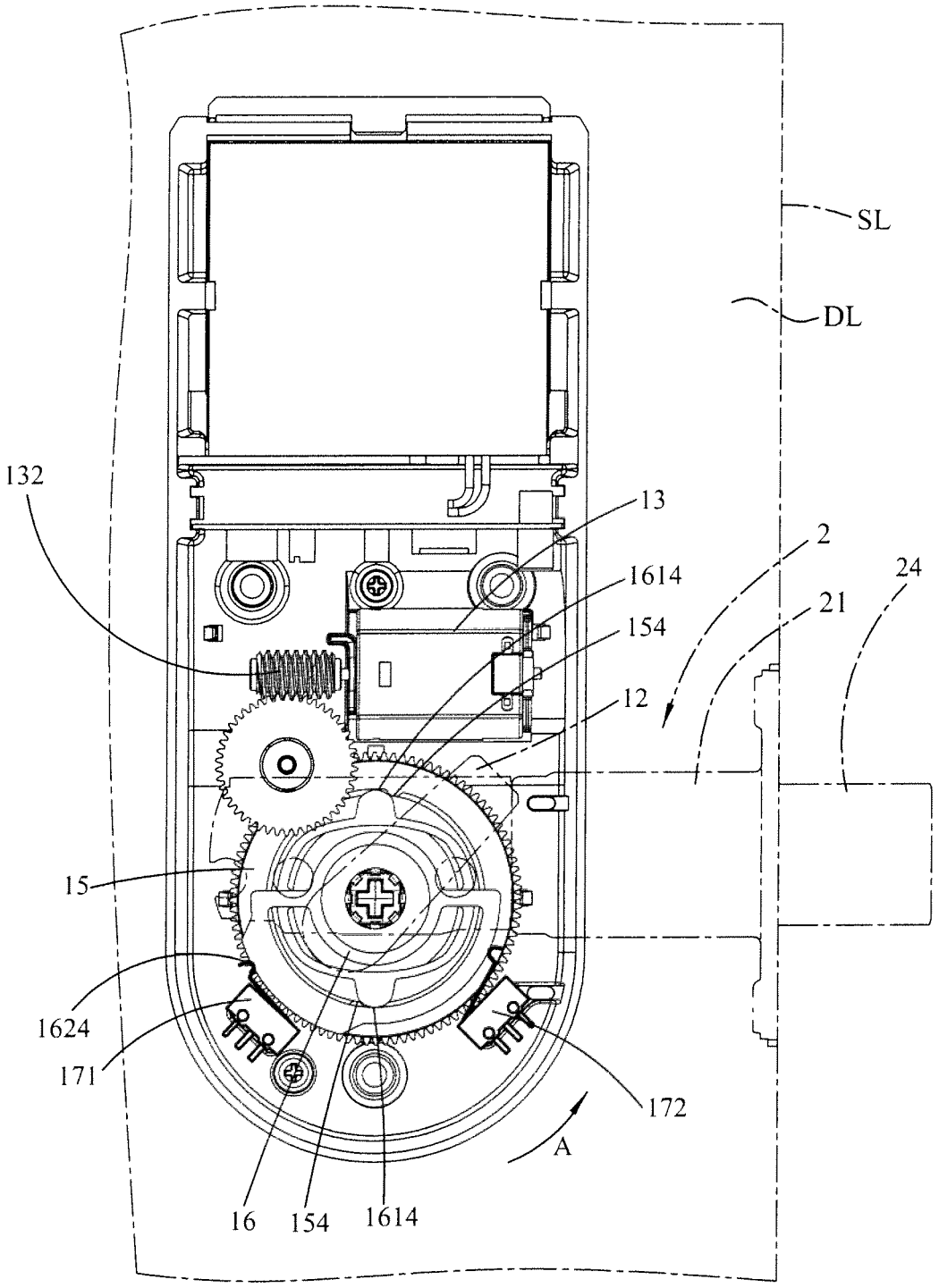

In step L3, after step L2, the control unit 17 controls the driving device 13 of the driving unit 10 to operate for driving the rotational actuator 16 and the protrusion 1624 to rotate in a second direction from the first switch 171 that is initially un-pressed to the second switch 172 that is initially pressed (i.e., the direction (A) in FIG. 10 opposite to the direction (B) in FIG. 8), and for driving the latch 24 to move from the latched position toward the unlatched position.

In step L4, when the latch 24 is moved to the unlatched posit ion and when the protrusion 1624 is rotated to the second angular position, the second switch 172 is pressed to send the second signal, and the control unit 17 stops the driving unit 10 in response to receipt of the second signal.

In step L5, the control unit 17 confirms that the electronic door lock 4 is mounted to the left-handed door (DL) with a correct mounting direction when steps L1 to L4 are successfully implemented. Otherwise, the control unit 17 will further implement the step of outputting the warning signal informing that the electronic door lock 4 should be disassembled from the left-handed door (DL) for re-mounting. In this embodiment, the warning signal is outputted when step L2 is not implemented after step L1, when the control unit 17 fails to receive the first signal after the driving unit 10 operates for the predetermined length of time in step L1, or when the control unit 17 fails to receive the second signal after the driving unit 10 operates for the predetermined length of time in step L3. In this condition, the inside lock body 1 should be disassembled from the door, and the rotational actuator 16 should be adjusted by manually rotating the rotary handle 12. In order to re-mount the electronic door lock 4, the inside lock body 1 is disassembled from the door, so that the rotational actuator 16 can be adjusted for placing the protrusion 1624 correctly in the second angular position by manually rotating the rotary handle 12. After the inside lock body 1 is re-mounted to the door, steps L1 to L5 may be repeated.

Figure 9:
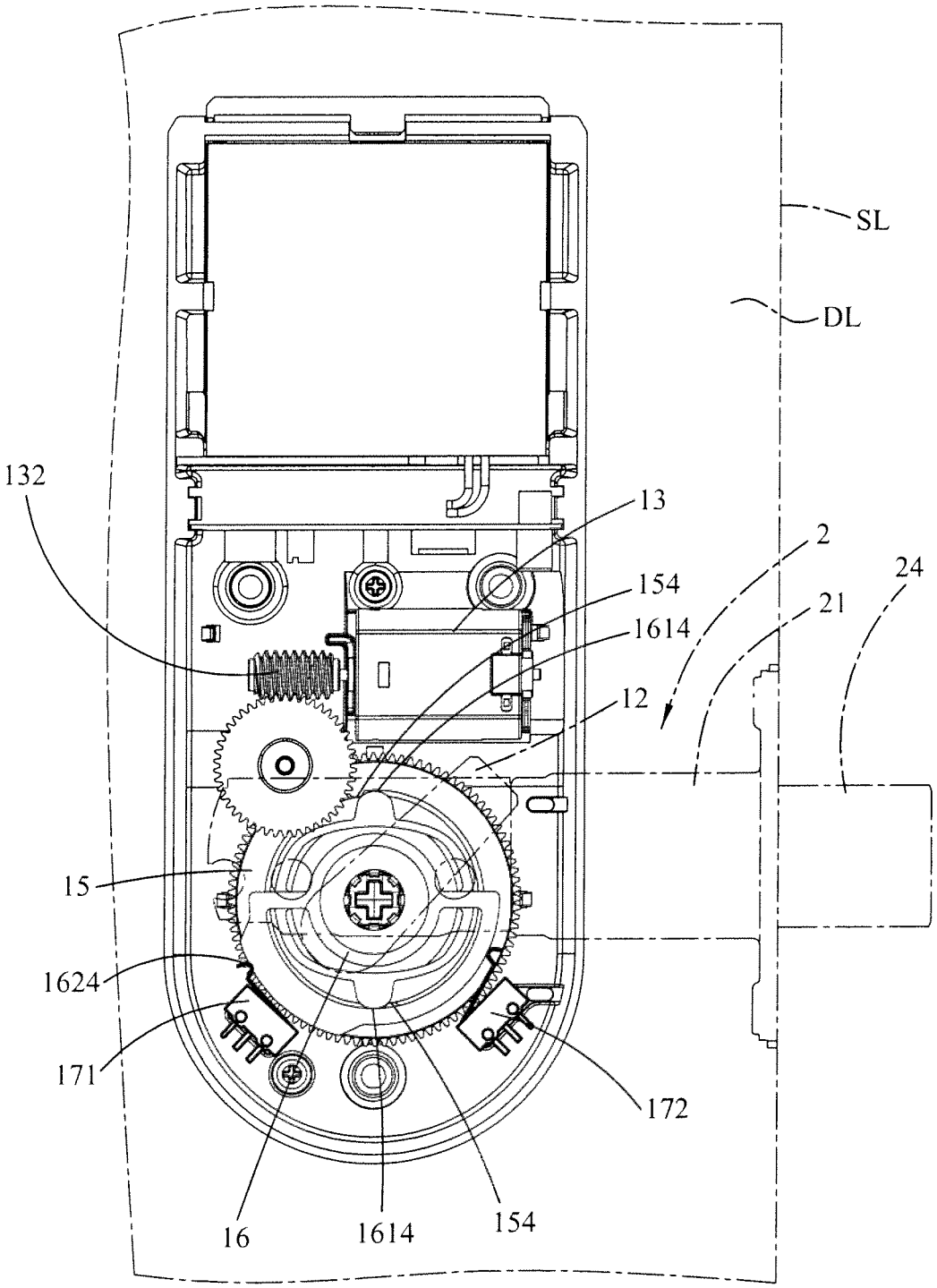

After the electronic door lock 4 is successfully mounted to the left-handed door (DL), as shown in FIG. 8, the protrusion 1624 of the rotational actuator 16 presses the second switch 172, so that the second switch 172 sends the second signal to the control unit 17 to inform the control unit 17 that the protrusion 1624 is placed at the second angular position corresponding to the unlatched position of the latch 24. On the other hand, when the protrusion 1624 is at the first angular position as shown in FIG. 9, the protrusion 1624 presses the first switch 171, so that the first switch 171 sends the first signal to the control unit 17 to inform the control unit 17 that the protrusion 1624 is placed at the first angular position corresponding to the latched position of the latch 24. The operation for locking and unlocking the electronic door lock 4 mounted on the left-handed door (DL) is similar to the operation of the electronic door lock 4 mounted to the right-handed door, and details thereof will be omitted herein for the sake of brevity.

It is worth mentioning that the control unit 17 is able to generate a warning signal and to control at the same time the driving unit 10 to stop from rotating if the first switch 171 or the second switch 172 is not pressed by the protrusion 1624 after the driving unit 10 has rotated for a predetermined time period, for example, 3 seconds.

In sum, the method for correctly mounting the electronic door lock 4 on a left-handed or right-handed door according to the embodiment of this disclosure can facilitate correct installation of the electronic door lock 4, and can inform the user that the electronic door lock 4 should be disassembled from the right-handed or left-handed door (DR, DL) for re-mounting when there is a mistake in mounting the electronic door lock 4.

While the present invention has been described in connection with what is considered the most practical embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A method for correctly mounting an electronic door lock on a left-handed door having an openable left side, or right-handed door having an openable right side, the electronic door lock including a latch and an inside lock body, the inside lock body including a rotary handle, a rotational actuator that includes a protrusion, a driving unit, a control unit, a first switch that is configured to send a first signal, and a second switch that is configured to send a second signal, the method comprising the steps of:

a) assembling the latch on the left-handed or right-handed door and placing the latch at an unlatched position, wherein: when the latch is assembled on the right-handed door, the latch is proximal to the openable right side; when the latch is assembled on the left-handed door, the latch is proximal to the openable left side;

b) after step (a), turning the rotary handle to rotate the rotational actuator in such a manner that the protrusion initially presses one of the first and second switches, and then, assembling the inside lock body on the left-handed or right-handed door, wherein the protrusion presses the first switch that is proximal to the openable right side when the electronic door lock is assembled on the right-handed door, and presses the second switch that is proximal to the openable left side when the electronic door lock is assembled on the left-handed door; and c) after the electronic door lock is assembled on the left-handed or right-handed door, electrically energizing the electronic door lock so that the control unit automatically implements an operating procedure for determining a correct mounting direction of the electronic door lock, the operating procedure including the steps of:

c1) when the protrusion initially presses the one of the first and second switches to generate one of the first and second signals, controlling the driving unit, in response to receipt of the one of the first and second signals, to drive the rotational actuator and the protrusion to rotate in a first direction from the one of the first and second switches that is initially pressed to the other one of the first and second switches that is initially un-pressed, and to drive the latch to move from the unlatched position toward a latched position;

c2) when the latch is moved to the latched position and when the protrusion presses the other one of the first and second switches that is initially un-pressed to send the other one of the first and second signals, the movement of the protrusion pressing the switch thereby stopping the rotational movement of the driving unit in response to receipt of the other one of the first and second signals;

c3) after step c2), controlling the driving unit to drive the rotational actuator and the protrusion to rotate in a second direction from the other one of the first and second switches that is initially un-pressed to the one of the first and second switches that is initially pressed, and to drive the latch to move from the latched position toward the unlatched position;

c4) when the latch is moved to the unlatched position and when the protrusion presses once again the one of the first and second switches that is initially pressed to send the one of the first and second signals, the movement of the protrusion pressing the switch thereby stopping the rotational movement of the driving unit in response to receipt of the one of the first and second signals; and c5) confirming that the electronic door lock is mounted to the left-handed or right-handed door with a correct mounting direction when steps c1) to c4) are successfully implemented.

2. The method of claim 1, wherein the operating procedure further includes the step of outputting a warning signal informing that the electronic door lock should be disassembled from the left-handed or right-handed door for re-mounting when step c2) is not implemented after step c1).

3. The method of claim 1, wherein the operating procedure further includes the step of outputting a warning signal informing that the electronic door lock should be disassembled from the left-handed or right-handed door for re-mounting when the control unit fails to receive the other one of the first and second signals after the driving unit operates for a predetermined length of time in step c1).

4. The method of claim 1, wherein the operating procedure further includes the step of outputting a warning signal informing that the electronic door lock should be disassembled from the left-handed or right-handed door for re-mounting when the control unit fails to receive the one of the first and second signals after the driving unit operates for a predetermined length of time in step c3).

5. The method of claim 1, wherein, in step a), the rotary handle has one grip portion adapted to be gripped by the user, and the electronic lock is assembled on the left-handed or right-handed door by inserting the rotary handle into a central hole of the rotational actuator and by aligning the protrusion of the rotational actuator with the grip portion of the rotary handle along a line parallel to a rotation axis of the rotational actuator.

6. A method for determining a correct mounting direction of an electronic door lock installed on a left-handed or right-handed door, the electronic door lock including a latch, a driving unit, a rotational actuator that includes a protrusion movable between first and second angular positions when the rotational actuator is driven by the driving unit, a control unit, a first switch, and a second switch angularly spaced apart from the first switch, the method to be implemented by the electronic door lock when the latch is initially placed at an unlatched position and when the protrusion is placed at one of the first and second angular positions, the protrusion pressing and actuating the first switch to send a first signal in the first angular position and pressing and actuating the second switch to send a second signal in the second angular position, the method comprising the steps of:

when the protrusion presses one of the first and second switches to send one of the first and second signals, controlling the driving unit, in response to the one of the first and second signals, to drive the rotational actuator and the protrusion to rotate in a first direction from the one of the first and second switches that is initially pressed to the other one of the first and second switches that is initially un-pressed and to drive the latch to move from the unlatched position toward a latched position;

when the latch is moved to the latched position and when the protrusion presses the other one of the first and second switches that is initially un-pressed to send the other one of the first and second signals, the movement of the protrusion pressing the switch thereby stopping the rotational movement of the driving unit in response to the other one of the first and second signals;

subsequently, controlling the driving unit to drive the rotational actuator and the protrusion to rotate in a second direction from the other one of the first and second switches that is initially un-pressed to the one of the first and second switches that is initially pressed and to drive the latch to move from the latched position toward the unlatched position;

when the latch is moved to the unlatched position and when the protrusion presses the one of the first and second switches that is initially pressed to send the one of the first and second signals, the movement of the protrusion pressing the switch thereby stopping the rotational movement of the driving unit in response to the one of the first and second signals; and confirming that the electronic door lock is mounted to the left-handed or right-handed door with a correct mounting direction when the preceding steps are successfully implemented.

* * * * *